United States Patent [19]

Fogg

[11] 4,449,254

[45] May 22, 1984

[54] GARMENT

[76] Inventor: Walter K. Fogg, 45 Kensington St., Feeding Hills, Mass. 01030

[21] Appl. No.: 326,575

[22] Filed: Dec. 2, 1981

[51] Int. Cl.[3] ..... A41B 9/04
[52] U.S. Cl. ..... 2/407
[58] Field of Search ..... 2/406, 407, 238, 403, 2/404, 409, 67

[56] References Cited

U.S. PATENT DOCUMENTS

| | | | |
|---|---|---|---|
| 2,599,769 | 6/1952 | MacRae et al. | 2/404 |
| 3,654,630 | 4/1972 | Block | 2/406 |
| 4,267,607 | 5/1981 | Tino | 2/409 |

*Primary Examiner*—Doris L. Troutman
*Attorney, Agent, or Firm*—Charles R. Fay

[57] ABSTRACT

A two part garment comprising a bikini bottom or high cut leg hole garment, and transparent pants in which the latter extends beyond the former and a short way down the thighs.

5 Claims, 4 Drawing Figures

GARMENT

BACKGROUND OF THE INVENTION

Many persons, especially female, would like to utilize modern swim wear fashions, e.g., the new (1981) high cut leg openings, and/or bikini bottoms, but do not do so because these revealing fashions show embarrassing expanses of fat deposits sometimes known as "cellulite", as well as other blemishes which are very difficult to remove and are certainly less than attractive, so that many feel forced to wear more old fashioned garments, and this also causes some embarrassment.

This invention provides a novel garment that can be worn to show the modern fashions but very unobtrusively covers the "cellulite" areas otherwise revealed.

SUMMARY OF THE DISCLOSURE

This invention accomplishes its purposes through the use of swim pants. This leg garment includes short legs extending a short distance down the upper thigh area covering the leg holes or openings of the new fashion high cuts and bikinis plus a short length of upper thigh. The legs are of a very different material from that of the swim suit or bikini itself, the latter being substantially opaque or nearly so, and the legs are as invisible as possible, being at least translucent and even transparent. The legs are preferably of stretchy material and are snug to the figure without creases or folds, and are intended to reveal the skin beneath, but largely concealing the "cellulite", etc. due to a good fit and snugness. This invention also includes other garments, e.g., briefs, hiphuggers, etc.

There are at least two forms of the leg construction, the high-cut swim suits and bikinis per se being well-known. One form of the leg is to make a full pants garment having a waist portion coincident with the waist or hipline of the high cut or bikini, in which case the waist (hipline) portions of the two garments can be attached by stitching, adhesives, etc. The legs of the garment extend out through the leg openings of the high cuts or bikinis and preferably the entire pants are interior of the high cut swim suit or bikini or other similar garment.

The other form of the garment is to make the legs only and attach to the edges of the leg openings of the swim suit. In either case, the garment legs extend out past the leg hole edges and down the thigh for a short distance. The distance the legs so extend can be varied in various garments to suit the desires of the customer.

Through the use of this invention, the features of both leg and modern swim suits are provided; the ugly lumps and bumps on hips, thighs, and buttocks are veiled, as well as are other blemishes, while the legs retain flesh tones to closely resemble skin color or complexion by using transparent or flesh colored veiling materail whether mesh, net, lace, or clear. The leg may also be opaque but matched to the color of the skin, although the transparent material is preferable as suiting most persons.

PREFERRED EMBODIMENT OF THE INVENTION

Figure 1:
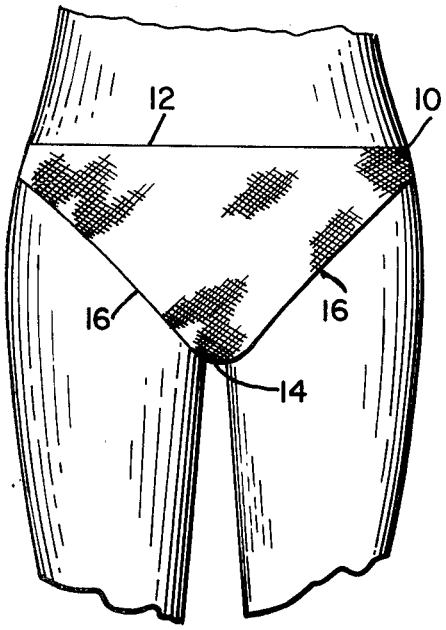
FIG. 1 illustrates a form of conventional bikini bottoms.

In FIG. 1, there is shown the front aspect of a conventional bikini bottom, which is indicated at 10. Its uppermost edge is on the hipline at 12, or close thereto. It has the usual crotch 14 and leg holes having edges at 16. These leg holes may be conventional, or even high cut as at 18 in FIG. 5.

Figure 2:
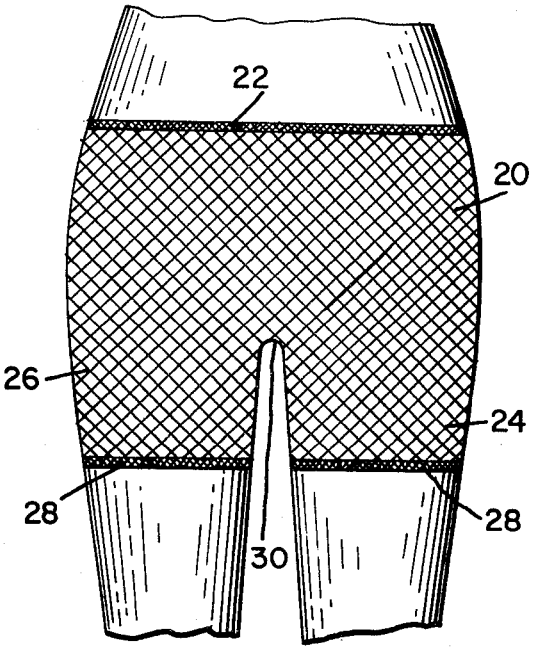
FIG. 2 is a like showing of a form of bikini garment pants.

A mesh, net, or lace-like pants 20, FIG. 2, is provided. This has hip line 22, legs 24, 26, and leg openings 28, as well as a crotch 30.

Figure 3:
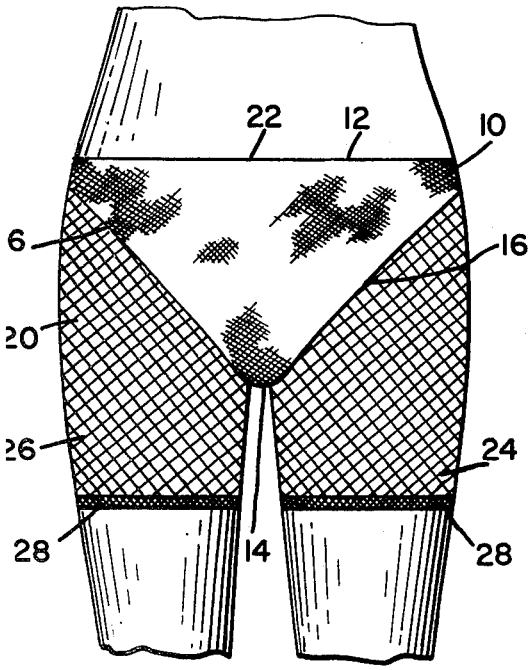
FIG. 3 illustrates both garments with the bikini garment inside the bikini bottom.
Figure 4:
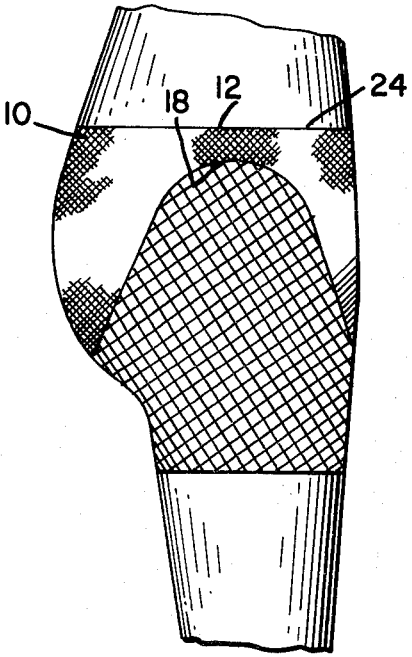
FIG. 4 is a view similar to FIG.3, but showing a side view.

FIG. 3 shows the combination of the conventional bikini bottom and the pants, known as bikini garments, which are inside the bikini bottom. These two garments are preferably secured together at the hip line 12,22, but the legs, 24,26 may be separate and secured at edges 16, as by stitching, adhesives, etc.

In any event, the diaphanous net, lace, or mesh legs 24,26, extend outwardly from the bikini leg openings and a short way down the upper thighs, as shown, and carry out the objects of the invention by obscuring the blemishes, cellulite, etc. appearing on hips, thighs, and buttock. It will be seen that this combination carries out the objects of the invention and allows otherwise too embarrassed persons to wear bikini bottoms.

Figure 5:
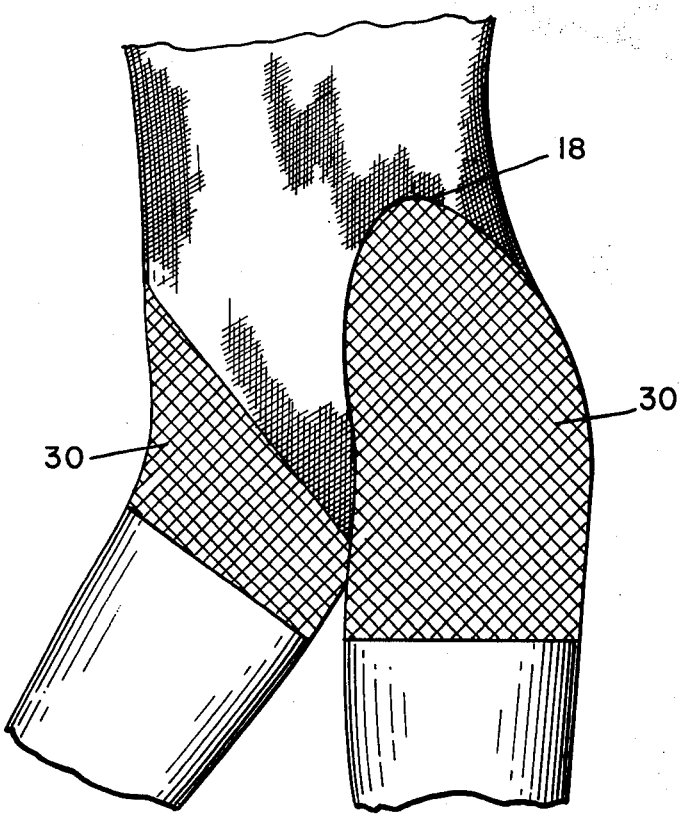
FIG. 5 is a view illustrating a high cut leg hole garment supplied with legs according to this invention.

FIG. 5 shows a slight variation. The bikini garments are the same but cooperate with swim suits that are not bikinis but have "high cut" leg openings 18 that may reveal blemishes veiled by the transparent legs 30 that may be part of a pants, or separate and attached at the edges of the leg holes. The objects of the invention are carried out by this construction also, and persons too embarrassed to wear bikini bottoms and/or high cut leg holes may now do so without embarrassment through the use of this invention.

I claim:

1. A bikini-type garment having a hip portion and front, rear, and crotch portions there being high cut leg openings from the crotch to points adjacent the hip portion, and an undergarment therefor including a hip portion and legs, the legs extending out through and beyond the leg openings and covering the high cut leg openings, said legs being snug and form fitting and tending to cover skin imperfections exposed by the leg openings, and means securing the undergarment to the garment.

2. The garment of claim 1 which is reversible so that the undergarment is outside the garment.

3. The garment of claim 1 wherein the undergarment is opaque.

4. The garment of claim 1 wherein individual legs of the undergarment are secured to the edges of the high cut leg openings.

5. The garment of claim 1 wherein the individual legs are secured at the hip portion thereof to the hip portion of the garment.

* * * * *